US006069290A

United States Patent [19]

Wagner

[11] Patent Number: 6,069,290

[45] **Date of Patent: *May 30, 2000**

[54] WASTE TREATMENT PROCESS AND REACTANT METAL ALLOY

[75] Inventor: Anthony S. Wagner, Bee Caves, Tex.

[73] Assignee: Clean Technologies International Corporation, Bee Caves, Tex.

[ * ] Notice: This patent is subject to a terminal disclaimer.

[21] Appl. No.: 09/088,510

[22] Filed: Jun. 1, 1998

Related U.S. Application Data

[63] Continuation-in-part of application No. 08/704,307, Oct. 15, 1996, Pat. No. 5,832,845, which is a continuation-in-part of application No. 08/328,270, Oct. 3, 1994, Pat. No. 5,564,351, which is a continuation-in-part of application No. 08/319,640, Oct. 7, 1994, which is a continuation-in-part of application No. 08/225,612, Apr. 11, 1994, Pat. No. 5,461,991, which is a continuation-in-part of application No. 08/103,122, Aug. 9, 1993, Pat. No. 5,359,947, which is a continuation-in-part of application No. 07/982,450, Nov. 27, 1992, Pat. No. 5,271,341, which is a continuation-in-part of application No. 07/669,756, Mar. 15, 1991, Pat. No. 5,167,919, which is a continuation-in-part of application No. 07/524,278, May 16, 1990, Pat. No. 5,000,101.

[51] Int. Cl.[7] ..... G21F 9/00; A62D 3/00; F23G 11/00

[52] U.S. Cl. ..... 588/1; 110/346; 110/237; 588/19; 588/201

[58] Field of Search ..... 588/1, 201, 19; 110/346, 237

[56] References Cited

U.S. PATENT DOCUMENTS

| | | | |
|---|---|---|---|
| 4,469,661 | 9/1984 | Shultz . | |
| 4,552,667 | 11/1985 | Shultz | 1/70 |
| 4,571,307 | 2/1986 | Bonniaud et al. | 252/628 |
| 4,666,696 | 5/1987 | Shultz | 53/34 |
| 5,000,101 | 3/1991 | Wagner | 110/346 |
| 5,167,919 | 12/1992 | Wagner | 420/538 |
| 5,271,341 | 12/1993 | Wagner | 110/346 |
| 5,359,947 | 11/1994 | Wagner | 110/346 |
| 5,431,113 | 7/1995 | Wagner | 110/237 |
| 5,452,671 | 9/1995 | Wagner | 110/346 |
| 5,461,991 | 10/1995 | Wagner | 110/346 |
| 5,564,351 | 10/1996 | Wagner | 110/346 |
| 5,640,702 | 6/1997 | Shultz | 588/1 |

*Primary Examiner*—Gary P. Straub
*Assistant Examiner*—Melanie C. Wong
*Attorney, Agent, or Firm*—Russell D. Culbertson; Shaffer & Culbertson, LLP

[57] ABSTRACT

A waste treatment process includes charging a reactor container (12) with a reactant alkaline metal alloy (10) and isolating the reactant alloy from oxygen gas. After heating the reactant alloy (10) in the reactor container (2) to a minimum of 770 degrees Celsius, a waste material is introduced into the molten alloy, preferably below the surface of the alloy. The waste material is pyrolized in the reactant alloy (10) to produce useful chlorine salts and other materials. The reactant alloy (10) includes magnesium and/or lithium, aluminum, zinc, calcium, and copper.

10 Claims, 1 Drawing Sheet

WASTE TREATMENT PROCESS AND REACTANT METAL ALLOY

RELATED APPLICATIONS

This application is a continuation-in-part of Ser. No. 08/704,307, filed Oct. 15, 1996 entitled "Equipment for Using Molten Metal Reactive Media for the Treatment of Hazardous Waste", now U.S. Pat. No. 5,832,845 which is a continuation in part of Ser. No. 08/328,270 filed Oct. 3, 1994, now U.S. Pat. No. 5,564,351 which is a continuation in part of Ser. No. 08/319,640 filed Oct. 7, 1994 which is a continuation-in-part of Ser. No. 08/225,612, filed Apr. 11, 1994, entitled "Equipment and Process for Molten Alloy Pyrolysis of Hazardous Liquid Waste", now U.S. Pat. No. 5,461,991, which is a continuation-in-part of Ser. No. 08/103,122, filed Aug. 9, 1993, entitled "Equipment and Process for Waste Pyrolysis and Off Gas Oxidative Treatment", now U.S. Pat. No. 5,359,947, which is a continuation-in-part of Ser. No. 07/982,450, filed Nov. 27, 1992, entitled "Equipment and Process for Medical Waste Disintegration and Reclamation", now U.S. Pat. No. 5,271,341, which is a continuation-in-part of Ser. No. 07/669,756, filed Mar. 15, 1991, entitled "Waste Treatment and Metal Reactant Alloy Composition", now U.S. Pat. No. 5,167,919, which is a continuation-in-part of Ser. No. 07/524,278, filed May 16, 1990, entitled "Hazardous Waste Reclamation Process", now U.S. Pat. No. 5,000,101.

TECHNICAL FIELD OF THE INVENTION

This invention relates to waste treatment processes, and particularly to a treatment process utilizing molten alkaline metal alloys for chemically reacting with waste materials. The invention also encompasses a reactant metal alloy for use in the waste treatment process.

BACKGROUND OF THE INVENTION

Many waste treatment processes utilize thermal energy to break up waste materials into their constituent elements or more desirable compounds. The use of thermal energy generally to break down materials is referred to as pyrolization. Molten metals have been used as a reactant for pyrolizing certain waste materials. In particular, molten aluminum has been used to react with halogenated hydrocarbons and produce aluminum salts. U.S. Pat. No. 4,469,661 to Schultz described the destruction of PCB and other halogenated hydrocarbons by contacting the PCB vapor with molten metallic aluminum. The aluminum was contained in low-boiling eutectic mixtures of aluminum and zinc or aluminum, zinc and magnesium. Schultz also suggested eutectic reactant mixtures containing iron, calcium, and other metals.

U.S. Pat. No. 5,000,101 to Wagner disclosed a process for pyrolizing hazardous waste material in molten alkaline metal alloys. The molten metal alloy comprised approximately 50% aluminum, 5% to 15% calcium, 5% to 15% copper, 5% to 15% iron, and 5% to 15% zinc. U.S. Pat. No. 5,167,919 to Wagner disclosed a reactant alkaline metal alloy composition comprising between 40% to 95% aluminum, 1% to 25% iron, 1% to 25% calcium, 1% to 25% copper, and 1% to 25% zinc. The '919 Wagner patent also disclosed that magnesium could be substituted for calcium but this substitution was seen as having no advantage. In both of these Wagner patents, the waste material was reacted in the molten alloy held at about 800 degrees Celsius.

In the process disclosed in the above-described Wagner patents, chlorine atoms in the waste material was stripped from the waste compound by the highly reactive aluminum in the reactant molten alloy. The aluminum and chlorine combined to form aluminum chloride. Both the aluminum chloride and carbon released from the waste material in the pyrolization process sublimed to a gaseous state at the 800 degree Celsius reaction temperature and were drawn off and separated.

SUMMARY OF THE INVENTION

It is an object of the invention to provide a waste treatment process for treating halogenated hydrocarbons and particularly chlorinated hydrocarbons to produce carbon compounds and useful chlorine salts. Another object of the invention is to provide reactant alkaline metal alloy compounds for producing useful chlorine salts from chlorinated hydrocarbons.

In order to accomplish these objects, the present waste treatment process utilizes a molten reactant metal alloy compound including significant quantities of magnesium or lithium, or both, to react with the chlorine atoms in the waste compound being treated. One preferred reactant metal alloy comprises an alloy of magnesium, aluminum, zinc, calcium, and copper. In another preferred form of the invention, the reactant alloy comprises lithium, aluminum, zinc, calcium, and copper. In yet another embodiment of the invention, the reactant alloy comprises magnesium, lithium, aluminum, zinc, calcium, and copper.

In each case, the alloy is heated to a molten state and to at least 770 degrees Celsius. The reactant alloy is preferably heated by a fossil fuel burner although any suitable heating arrangement, such as an induction heater, may be used within the scope of the invention. The particular reactant alloy is held in the molten state in a reactor container isolated from oxygen. The isolation from oxygen prevents excessive oxide formation and prevents oxidation of the elemental carbon released in the pyrolization process. The waste material, and particularly chlorinated hydrocarbons, are introduced directly to the reactant molten alloy preferably below the surface of the molten material.

The magnesium or lithium in the reactant alloy chemically strips chlorine atoms from the chlorinated hydrocarbons to form magnesium chloride salt or lithium chloride salt. These chlorine salts along with carbon freed from the waste material in the form of elemental carbon, CH, $CH_2$, or $CH_3$ sublime to a gaseous state at the temperature of the molten alloy. Carbon, CH, $CH_2$, and $CH_3$ produced in the pyrolization process according to the invention will be referred to herein as char. The gas released in the treatment process is drawn off and scrubbed in an aqueous scrubber/separator to produce a slurry of char and salt solution. The salt solution is then separated and processed to recover the chlorine salt while the separated char is dried.

These and other objects, advantages, and features of the invention will be apparent from the following description of the preferred embodiments, considered along with the accompanying drawings.

DESCRIPTION OF THE PREFERRED EMBODIMENTS

Figure 1:
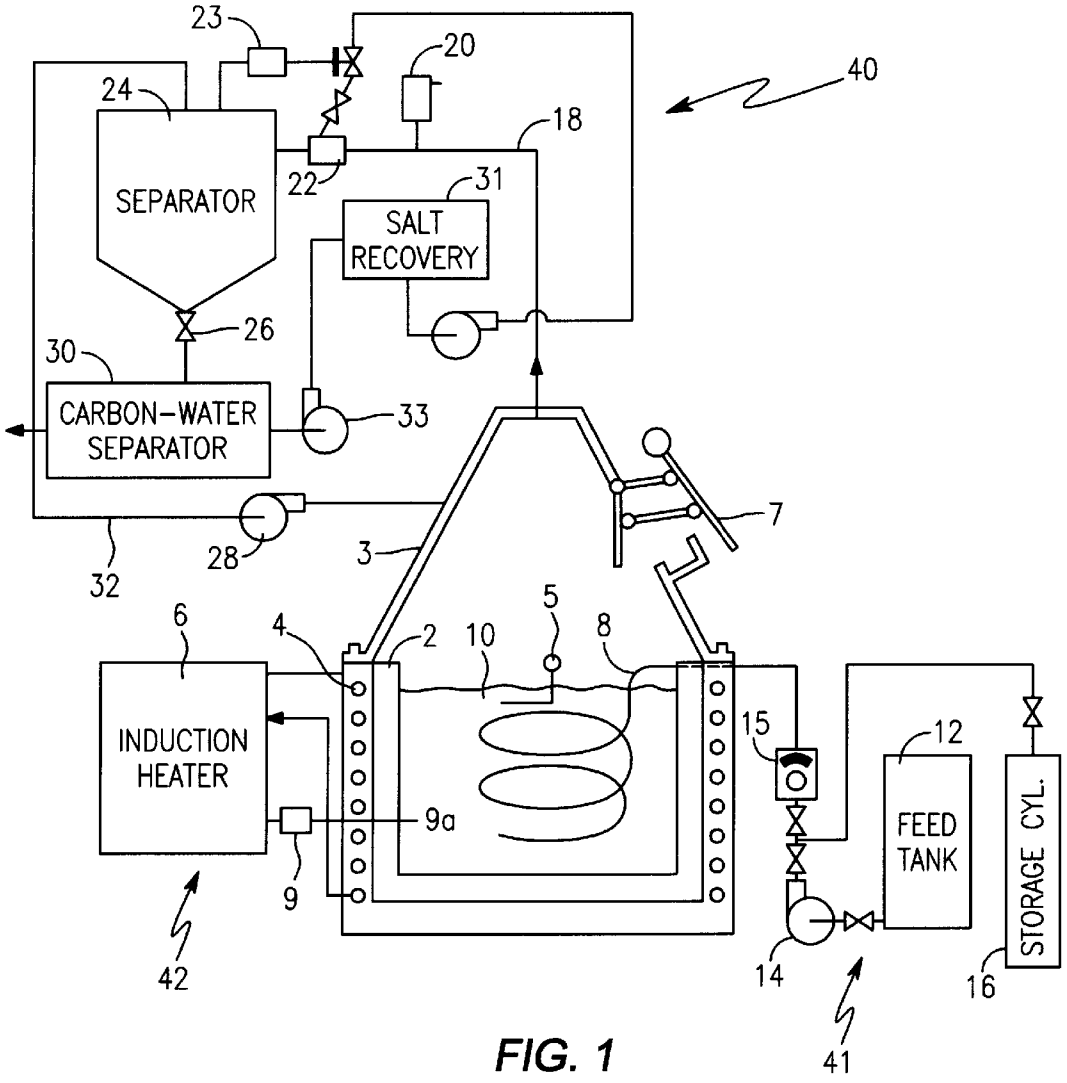
FIG. 1 is a diagrammatic representation of an apparatus for performing a treatment process embodying the principles of the invention.

The invention comprises a reactant alkaline metal alloy composition including significant quantities of magnesium and/or lithium to react with halogenated hydrocarbons, and particularly chlorinated hydrocarbons, to produce magnesium chloride and/or lithium chloride salt. One form of the invention comprises an alloy including between 10% to 70% magnesium, 10% to 70% aluminum, 1% to 25% zinc, 1% to 25% calcium, and 1% to 25% copper. Within this range, the preferred reactant alloy includes 50% magnesium, 40% aluminum, 4% zinc, 4% calcium, and 2% copper. As used in this disclosure and the appended claims, all percentages are by weight in the total alloy composition.

Where the alloy is lithium based without magnesium, the reactant metal alloy composition according to the invention comprises between about 10% to 70% lithium, 10% to 70% aluminum, 1% to 25% zinc, 1% to 25% calcium, and 1% to 25% copper. Within this range, the preferred lithium alloy comprises 40% lithium, 45% aluminum, 1% zinc, 7% calcium, and 7% copper. Another preferred specific alloy compound including lithium comprises approximately 30% lithium, 46% aluminum, 2% zinc, 2% copper, and about 20% calcium.

Another preferred form of the invention comprises a reactant metal alloy which includes both magnesium and lithium. This preferred reactant alloy composition comprises between about 1% to 60% magnesium, 10% to 70% lithium, 10% to 70% aluminum, 1% to 25% zinc, 1% to 25% calcium, and 1% to 25% copper.

With each reactant metal alloy composition according to the invention, the alloy is heated to a molten state for chemical reaction with the waste material. The temperature of the molten alloy is maintained at least at 770 degrees Celsius to provide the desired reaction with the waste material. Higher temperatures for the molten alloy may also be used within the scope of the invention. A reaction temperature of at least 800 degrees Celsius is suitable for the preferred magnesium alloy composition containing 65% magnesium. The lithium based reactant alloy comprising 40% lithium is preferably maintained at least at 900 degrees Celsius for the reaction process. The preferred alloy comprising 30% lithium is preferably heated to at least 1,000 degrees Celsius for the reaction process.

The reactant metal alloy composition and treatment process according to the invention may be used to treat many types of waste materials, including all halogenated hydrocarbons. However, the present alloy and process is particularly useful for chlorinated hydrocarbons such as PCBs (polychlorinated biphenyls). The magnesium alloy composition according to the invention is well suited for treating chlorinated hydrocarbons because the magnesium in the alloy chemically strips chlorine atoms from the waste material compound or compounds to produce magnesium chloride. The recovered magnesium chloride may be used as a feedstock in commercial magnesium refining processes.

While the magnesium in the magnesium alloy according to the invention strips chlorine from the waste compounds to produce magnesium chloride salt, other elements in the waste material, such as phosphorous, sulphur, and nitrogen, are also stripped from the carbon atoms in the waste material. Much of this other stripped material forms salts (sulfates, nitrates, phosphates) which separate by gravity at the top of the molten reactant material for recovery by suitable means. The magnesium chloride salt and char both sublime to a gaseous state and are drawn off for separating and recovering the magnesium chloride salt and char. Metals such as chromium in the waste material remain in the molten alloy. The original metals which make up the alloy remain in the molten alloy unless consumed in the formation of salts and small quantities of oxides.

The treatment process according to the invention includes charging a reactor container with the desired magnesium and/or lithium based alloy composition and isolating the alloy in the reactor from oxygen. The reactant alloy is then heated by a suitable heating arrangement to at least 770 degrees Celsius. Any remaining oxygen in the reactor vessel quickly reacts with the metal in the alloy to produce metal oxides which appear as slag at the surface of the molten material or sink to the bottom of the reaction container. In the preferred process a layer of pure carbon in the form of graphite is placed at the surface of the molten reactant metal alloy. The graphite layer may be from approximately one-quarter to several inches thick and helps further isolate the molten alloy from any oxygen which may be in the reactor container. Once the molten alloy reaches the desired reaction temperature, the process includes introducing the waste material into the reactant molten alloy. The waste material is preferably introduced below the surface of the molten alloy but may be introduced at the surface of the alloy. The temperature of the metal alloy is maintained at least at a temperature of about 770 degrees Celsius throughout the reaction process. Although heat will commonly need to be added continuously by the heating arrangement in order to maintain the desired reaction temperature, the chemical reaction between the waste material and the metal alloy may be sufficiently exothermal to help maintain the temperature of the molten alloy above the desired 770 degree Celsius level.

FIG. 1 shows an apparatus for performing a treatment process embodying the principles of the invention. The apparatus includes a reactor container 2, a recovery/recirculation arrangement 40, a feed arrangement 41, and a heating arrangement 42. The reactor container 2 is preferably built from a suitable metal which will maintain structural integrity at the desired elevated temperatures. However, due to the highly reactive nature of the alloy 10, the reactor container 2 is lined with a ceramic material to prevent the metal of the container from reacting with the reactant alloy. An expendable hook 5 may be placed in the alloy 10 at the termination of the process and, after cooling, may be used to lift the solidified alloy ingot from the reactor container 2.

The reactor container 2 also includes a cover 3 which contains a solids loading chute 7. The solids loading chute 7 preferably comprises a double reverse acting door so that when the outer door is open to charge solid waste into the chute, the inner door is closed, but the outer door is closed when the inner door is opened to drop the solid waste into the molten alloy 10. It is desirable to purge most of the air out of the charging chute 7 before admitting waste to minimize metal oxide formation in the anaerobic system of the invention. Of course, the aluminum and magnesium in the molten alloy 10 rapidly reacts with any oxygen under cover 3 to remove oxygen from the gas above the molten alloy bed 10.

The heating arrangement 42 includes an induction heater, including an induction heater power supply 6 and induction coils 4 built into the reactor container 2. The coils 4 may be water-cooled and the water may be used to cool the reactant alloy 10 as desired, either during the reaction process or at the completion of the reaction process. The induction heater arrangement 42 includes a heater control 9 with a suitable sensor 9*a* inside the reactor container 2 for controlling the induction heater and maintaining the temperature of the metal alloy 10 at the desired reactive temperature. Although the induction heating arrangement is illustrated in FIG. 1, any suitable heating arrangement, including fossil fuel burning heater may be used to heat the alloy 10 to the desired temperature.

The feed arrangement 41 includes feed tank 12 and feed coil 8. Feed tank 12 contains waste material to be processed. A feed pump 14 pumps the waste material from feed tank 12 to the reactor container 2 through a metering arrangement 15. The metering arrangement ensures that waste material is not transferred to the reactor container at a rate exceeding the capacity of the heater arrangement 42 to maintain the desired reaction temperature. Feed coil 8 is coated on its interior and exterior surfaces or formed from a ceramic material to prevent the coil from reacting with the molten alloy 10 in reactor 2. The outlet end of the coil is positioned well below the surface of the alloy 10. Passing the feed material through coil 8 serves to preheat the feed material prior to introduction to the molten alloy 10. The feed system 41 also preferably includes a gas purging arrangement including a gas storage cylinder 16 for containing a suitable purge gas such as nitrogen. The gas purging arrangement is operated to purge the feed lines and coil 8 of air prior to operation of the system. Gases other than nitrogen may be used to purge the system of oxygen, including flue gases such as gases from a fossil fuel burning heater arrangement.

The recovery/recirculation system 40 includes an aqueous scrubber/separator 24, a char/water separator 30, a salt recovery arrangement 31, and a recirculation arrangement 32. Off-gas from the area above the molten alloy 10 in container 2 comprising gaseous magnesium or lithium chloride salt, char, and other gases are drawn off through line 18. Line 18 is preferably made of stainless steel and includes a relief valve 20 to maintain atmospheric pressure on line 18. A water spray nozzle 22 is associated with the scrubber/separator 24 and serves to spray water into the off-gas at the inlet to the scrubber/cyclone separator. The water sprayed into the off-gas causes the char to coalesce while the salt in the off-gas goes into solution in the water. The amount of water supplied through nozzle 22 is preferably controlled with temperature controller 23 to maintain the temperature below about 100 degrees Celsius in the scrubber/separator 24. A char slurry forms in the bottom of the scrubber/separator 24 and is drawn off through valve 26. The slurry comprises char and water with salt in solution. The char slurry is directed to char/water separator 30 which separates out the fine char particles from the water solution and passes the water solution through pump 33 on to salt recovery system 31. Salt recovery system 31 may comprise an evaporative system. Water from salt recovery system 31 may be recycled to nozzle 22. Any gas from separator/scrubber 24 is drawn off through recirculation fan 28 and reintroduced to the area above the molten alloy 10 for recycling through the system.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. A waste treatment process comprising the steps of:

(a) charging a reactor container with a reactant alloy comprising aluminum, magnesium, zinc, calcium, and copper;

(b) isolating the reaction alloy in the reactant container from oxygen gas;

(c) heating the reactant alloy in the reactor container to a minimum of the 770 degrees Celsius thereby placing the reactant alloy in a molten state;

(d) introducing a waste material into the molten reactant alloy; and (e) maintaining the reactant alloy in the reactor container at a minimum of about 770 degrees Celsius.

2. The waste treatment process of claim 1 wherein the reactant alloy comprises:

(a) between about 1% to 25% zinc;

(b) between about 1% to 25% calcium;

(c) between about 1% to 25% copper;

(d) between about 10% to 70% magnesium; and (e) between about 10% to 70% aluminum.

3. The waste treatment process of claim 1 wherein the reactant alloy comprises:

(a) 4% zinc;

(b) 4% calcium;

(c) 2% copper;

(d) 50% magnesium; and (e) 40% aluminum.

4. The waste treatment process of claim 1 wherein the reactant alloy is maintained at a minimum temperature of about 800 degrees Celsius.

5. The waste treatment process of claim 1 further comprising the step of:

(a) maintaining a layer of graphite at the surface of the molten reactant alloy.

6. A waste treatment process comprising the steps of:

(a) charging a reactor container with a reactant alloy comprising aluminum, lithium, zinc, calcium, and copper;

(b) isolating the reactant alloy in the reactor container from oxygen gas;

(c) heating the reactant alloy in the reactor container to a minimum of the 770 degrees Celsius to place the reactant alloy in a molten state;

(d) introducing a waste material into the molten alloy; and (e) maintaining the reactant alloy in the reactant container at a minimum of about 770 degrees Celsius.

7. The waste treatment process of claim 6 wherein the reactant alloy comprises:

(a) between about 1% to 25% zinc;

(b) between about 1% to 25% calcium;

(c) between about 1% to 25% copper;

(d) between about 10% to 70% lithium; and (e) between about 10% to 70% aluminum.

8. The waste treatment process of claim 6 wherein the reactant alloy comprises:

(a) 1% zinc;

(b) 7% calcium;

(c) 7% copper;

(d) 40% lithium; and (e) 45% aluminum.

9. The waste treatment process of claim 6 wherein the reactant alloy is maintained at a minimum temperature of about 900 degrees Celsius.

10. The waste treatment process of claim 6 further comprising the step of:

(a) maintaining a layer of graphite at the surface of the molten reactant alloy.

* * * * *